US012129744B2

(12) United States Patent
Faraoun

(10) Patent No.: US 12,129,744 B2
(45) Date of Patent: Oct. 29, 2024

(54) DOWNHOLE PUMPING TOOL

(71) Applicant: WELLTEC A/S, Allerød (DK)

(72) Inventor: Abderrahmane Faraoun, Zug (CH)

(73) Assignee: WELLTEC A/S, Allerød (DK)

( * ) Notice: Subject to any disclaimer, the term of this patent is extended or adjusted under 35 U.S.C. 154(b) by 0 days.

(21) Appl. No.: 17/699,313

(22) Filed: Mar. 21, 2022

(65) Prior Publication Data

US 2022/0298893 A1 Sep. 22, 2022

(30) Foreign Application Priority Data

Mar. 22, 2021 (EP) ..... 21164020

(51) Int. Cl.
*E21B 41/00* (2006.01)
*E21B 27/02* (2006.01)

(52) U.S. Cl.
CPC ..... *E21B 41/0099* (2020.05); *E21B 27/02* (2013.01); *E21B 2200/08* (2020.05)

(58) Field of Classification Search
CPC .. E21B 41/0099; E21B 27/02; E21B 2200/08; E21B 37/00; E21B 43/128; E21B 49/082
See application file for complete search history.

(56) References Cited

U.S. PATENT DOCUMENTS 5,950,732 A * 9/1999 Agee ..... E02F 3/88 299/8
2017/0114636 A1* 4/2017 Krüger ..... E21B 49/081
2019/0316443 A1* 10/2019 Haugland ..... E21B 27/00
2020/0123885 A1* 4/2020 Yamamoto ..... E21B 43/16
2020/0300049 A1* 9/2020 Edvardsen ..... E21B 27/04
2022/0010641 A1* 1/2022 Haugland ..... E21B 27/00

FOREIGN PATENT DOCUMENTS

EP 2 955 320 12/2015
EP 3 218 574 9/2017

OTHER PUBLICATIONS

Extended European Search Report, EP21164020.6 dated Sep. 10, 2021, 7 pages.

* cited by examiner

*Primary Examiner* — Tara Schimpf
*Assistant Examiner* — Yanick A Akaragwe
(74) *Attorney, Agent, or Firm* — Nixon & Vanderhye P.C.

(57) ABSTRACT

The present invention relates to the use of a downhole pumping tool for removing a hydrate formation forming a hydrate plug in a tubing in a well, the downhole pumping tool comprising a pump having a pump inlet and a pump outlet, an electric motor for driving the pump, a wireline for powering the electric motor, the pump having a first end arranged closest to the wireline and a second end facing the hydrate plug, wherein the pump inlet is arranged in the second end, and the pump inlet contacts a first face of the hydrate plug, the pump providing suction to remove at least part of a plurality of gas molecules from the hydrate plug for dissolving at least part of the hydrate formation. The invention also relates to a hydrate removal method for removing hydrate formation forming a hydrate plug in a tubing.

20 Claims, 3 Drawing Sheets

DOWNHOLE PUMPING TOOL

Figure 4:
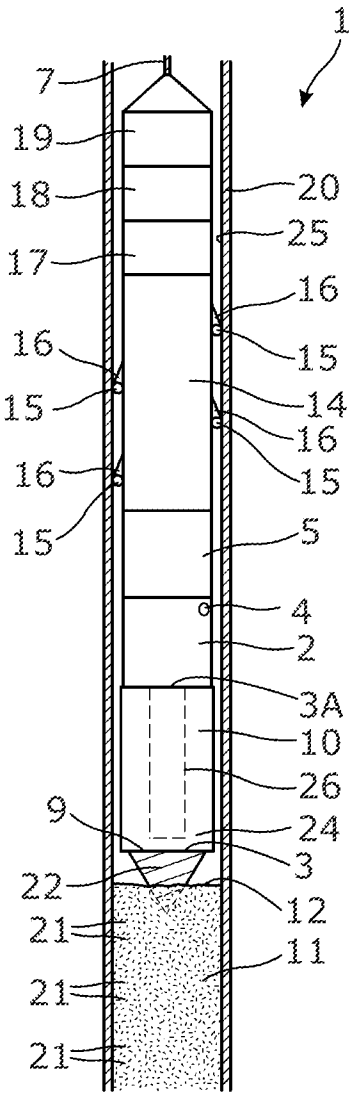

This application claims priority to EP 21164020.6 filed Mar. 22, 2021, the entire contents of which are hereby incorporated by reference.

The present invention relates to the use of a downhole pumping tool for removing a hydrate formation forming a hydrate plug in a tubing in a well. The invention also relates to a hydrate removal method for removing hydrate formation forming a hydrate plug in a tubing.

Gas hydrates are ice-like solids that form when free water and natural gas combine at high pressure and low temperature. This can occur in gas and gas/condensate wells, as well as in oil wells. Gas hydrates consist of molecules of gas, such as natural gas, e.g. methane, enclosed within a solid lattice of water molecules. Hydrate formation in a well tubing may form a hydrate plug closing off the part of the well below the hydrate plug. In order to remove the hydrate plug, a tool with glycol in a container is lowered into the well, and the glycol is pumped out of the container through an outlet nearest the hydrate plug. The glycol dissolves some of the hydrate, and the dissolved hydrate is pumped into the top of the tool until the container is emptied of glycol. Subsequently, the tool is retracted, emptied of dissolved hydrate and filled with glycol before the tool re-enters the well in order to remove more of the hydrate plug. However, this glycol-consuming process is expensive, time-consuming and not environmentally friendly.

It is an object of the present invention to wholly or partly overcome the above disadvantages and drawbacks of the prior art. More specifically, it is an object to provide an improved hydrate removal method which is less expensive, less time-consuming and more environmentally friendly than known solutions.

The above objects, together with numerous other objects, advantages and features, which will become evident from the below description, are accomplished by a solution in accordance with the present invention by the use of a downhole pumping tool for removing a hydrate formation forming a hydrate plug in a tubing in a well, the downhole pumping tool comprising:

a pump having a pump inlet and a pump outlet, an electric motor for driving the pump, and a wireline for powering the electric motor, the pump having a first end arranged closest to the wireline and a second end facing the hydrate plug, wherein the pump inlet is arranged in the second end, and the pump inlet contacts a first face of the hydrate plug, the pump providing suction to remove at least part of a plurality of gas molecules from the hydrate plug for dissolving at least part of the hydrate formation.

Use of a downhole pumping tool in a well for removing a hydrate formation forming a hydrate plug in a tubing in a well, the downhole pumping tool being configured to be arranged in a well tubular metal structure in a well and comprising:

a pump having a pump inlet and a pump outlet, an electric motor for driving the pump, and a wireline for powering the electric motor, the pump having a first end arranged closest to the wireline and a second end facing the hydrate plug, wherein the pump inlet is arranged in the second end, and the pump inlet contacts a first face of the hydrate plug, the pump providing suction to remove at least part of a plurality of gas molecules from the hydrate plug for dissolving at least part of the hydrate formation.

Furthermore, the pump outlet may be arranged closer to the first end than the second end.

By using the downhole pumping tool to suck gas molecules out of the top of the hydrate plug, the hydrate plug is dissolved part by part until the hydrate plug is collapsed and in this way dissolved, no longer preventing passage in the well. With such solution, there is no need for glycol, and a 150-metre-long hydrate plug can be removed/dissolved in one run, and not, as is the case with prior art tools, in several runs in order to transport sufficient glycol to dissolve the hydrate plug. Using the downhole pumping tool to suck gas molecules out of the top of the hydrate plug is an environmentally friendly way of removing a hydrate plug in a well, which is also less time-consuming than the known glycol solution.

The water generated by sucking the gas molecules out of the hydrate is then sucked into the pump inlet and out through the pump outlet and the pump inlet is moved downwards. The water is used to suck the gas molecules upwards away from the plug and to flow released hydrate pieces into the pump or the bailer of the pump.

Furthermore, the suction may remove at least part of the hydrate formation.

Moreover, the pump inlet may draw in at least part of the hydrate formation and/or gas molecules.

Also, the pump inlet may suck in at least part of the hydrate formation and/or gas molecules.

In addition, the pump outlet may release at least part of the hydrate formation as water and gas.

The pump sucks gas and dissolved hydrate in through the pump inlet and out of the pump outlet, and in this way the hydrate plug is removed section by section; as gas is released from the hydrate and pumped out of the pump outlet, which is closer to the top of the well than the inlet, the gas will travel up the tubing and up the well, and hydrate formation can no longer occur with that gas. The suction can be continued until the hydrate plug is fully removed.

Further, the pump may provide suction pressure at the pump inlet of at least 5 bar, preferably at least 7 bar, and even more preferably at least 10 bar.

By providing at least 5 bar differential pressure, suction of gas molecules out of the hydrate plug can still occur, even if the pump inlet is not in full contact with the first face of the hydrate plug.

Also, the pump inlet may be surrounded by an edge, and the pump inlet may contact the first face at least along 25% of the edge, and preferably at least along 50% of the edge.

By providing contact between the edge of the pump inlet at least along 25% of the edge, suction of gas molecules out of the hydrate plug can still occur, even if the pump inlet is not in full contact with the first face of the hydrate plug.

Furthermore, the pump inlet, at part of the edge, may have a distance of less than 5 mm, and preferably a distance of less than 2 mm.

Also, the edge may comprise at least one indentation so as to ensure a flow of fluid from the tool surroundings into the pump inlet.

Further, the second end may comprise at least one nozzle, valve or opening providing fluid communication between the well and the inside of the pump so as to ensure a flow of fluid from the tool surroundings into the pump.

Additionally, as the edge may comprise at least one indentation or the second end may be provided with at least one nozzle, valve or opening, a flow of fluid for sucking the gas molecules and possibly also water, in through the filter is upheld even though the pump inlet is blocked from an intake of well fluid if the inlet is sucked into the hydrate plug.

In addition, an outer face of the pump of the downhole pumping tool may have a distance to a wall of the tubing, where the distance is less than 50 mm, and preferably less than 25 mm.

Moreover, the pump may further comprise a bailer having a bailer inlet forming the pump inlet so that at least part of the hydrate formation and/or gas molecules are sucked in through the bailer.

Furthermore, the bailer may comprise a filter through which the gas molecules and dissolved water pass, leaving some of the hydrate formation released from the hydrate plug in the bailer.

The gas, water and collapsed lattice of solid water are sucked in through the pump inlet, forming the bailer inlet, and enter the bailer cavity before the water and gas are sucked in through the filter and out of the pump outlet. By having a bailer, the collapsed solid lattice of water is separated from the gas and accumulated in the bailer, and gas and dissolved water are let out of the pump outlet. In that way, some of the conditions forming the hydrate are removed so that hydrate formation can no longer occur, nor above the tool so that the tool is stuck in the tubing. The suction process for removing the hydrate plug can thus occur until the hydrate plug is fully removed from the tubing without any risk of hydrate forming above the tool. Several hundreds of metres of hydrate plug can thus be removed without having to retract the tool from the well.

In addition, the bailer may comprise a filter through which the gas molecules are sucked, leaving some of the hydrate formation in the bailer.

Further, the downhole pumping tool may comprise a driving unit having wheels on arms for contacting an inner face of the tubing to provide a forward-driving force forcing the pump inlet into contact with the first face of the hydrate plug.

The driving unit is used in order to minimise the distance between the pump inlet and the first face of the hydrate plug, and thus maximise the suction pressure at the pump inlet. Furthermore, the driving unit is used to maintain the contact between the pump inlet and the first face of the hydrate plug even during dissolving of the top part of the hydrate plug, e.g. if the weight of the downhole pumping tool is not enough to maintain the contact.

Also, the downhole pumping tool may further comprise a drill bit arranged in front of the second end for drilling into the hydrate plug.

The drill bit is used to drill into the top part of the hydrate plug and thus to create contact between the pump inlet of the hydrate plug, which is especially useful if the first face is very uneven.

Furthermore, the driving unit may be powered by a second pump which is powered by a second electric motor, the electric motor being powered by the wireline.

Moreover, the downhole pumping tool may be a downhole wireline pumping tool.

The wireline is also used for lowering the downhole pumping tool until the pump inlet contacts the hydrate plug.

In addition, the present invention relates to a hydrate removal method for removing hydrate formation forming a hydrate plug in a tubing, comprising:

lowering a downhole pumping tool comprising a pump having a pump inlet and a pump outlet, an electric motor for driving the pump, and a wireline for powering the electric motor, the pump having a first end arranged closest to the wireline and a second end facing the hydrate plug, the pump inlet being arranged in the second end, contacting a first face of the hydrate plug with the pump inlet, activating the pump to provide suction through the pump inlet, and removing at least part of a plurality of gas molecules from the hydrate plug, dissolving at least part of the hydrate formation.

Further, the method may comprise retracting the downhole pumping tool into a lubricator and circulating fluid in through the pump.

Also, the method may comprise sucking the plurality of gas molecules into a bailer of the pump after passing the pump inlet.

Furthermore, the method may comprise retracting the downhole pumping tool into a lubricator and circulating fluid in through the bailer.

Moreover, the method may comprise lowering the downhole pumping tool until the pump inlet contacts the first face of the hydrate plug.

In addition, the method may comprise activating the pump again to provide suction through the pump inlet, removing a further part of a plurality of gas molecules from the hydrate plug, and dissolving at least part of the hydrate formation.

Further, the method may comprise drilling into the first face of the hydrate plug, and releasing part of the formation by means of a drill bit arranged in front of the second end.

Also, the method may comprise forcing the pump inlet towards the first face of the hydrate plug by means of a driving unit having wheels on arms for contacting an inner face of the tubing, the wheels being driven to rotate.

Furthermore, the method may comprise providing a suction pressure by means of the pump at the pump inlet of at least 5 bar, preferably at least 7 bar, and even more preferably at least 10 bar.

Moreover, the pump inlet may be surrounded by an edge, and the method may further comprise contacting the first face by means of the pump inlet at least along 25% of the edge, and preferably at least along 50% of the edge.

Finally, the method may further comprise contacting the first face by means of the pump inlet so that part of the edge has a distance of less than 5 mm, and preferably a distance of less than 2 mm.

Figure 3:
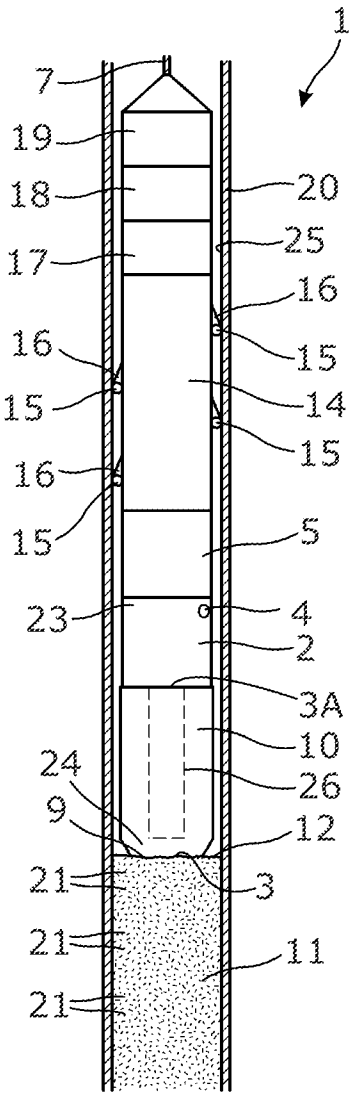
Figure 2:
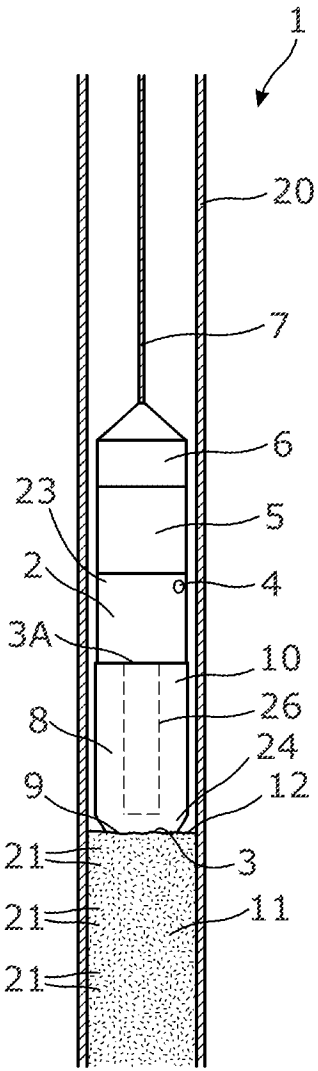
Figure 1:
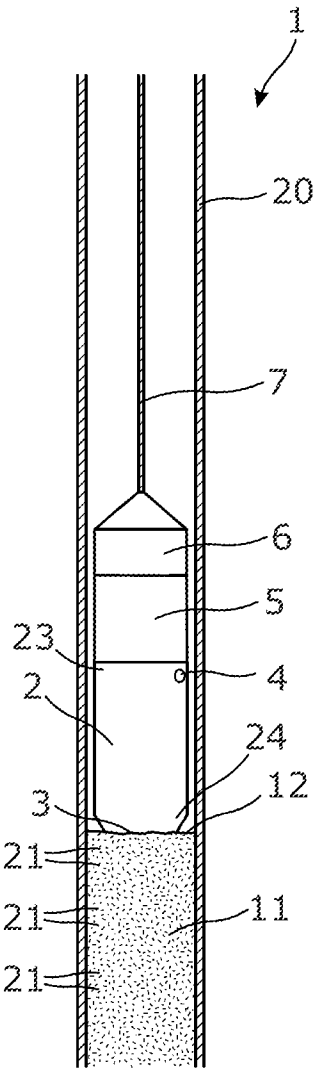
Figure 5:
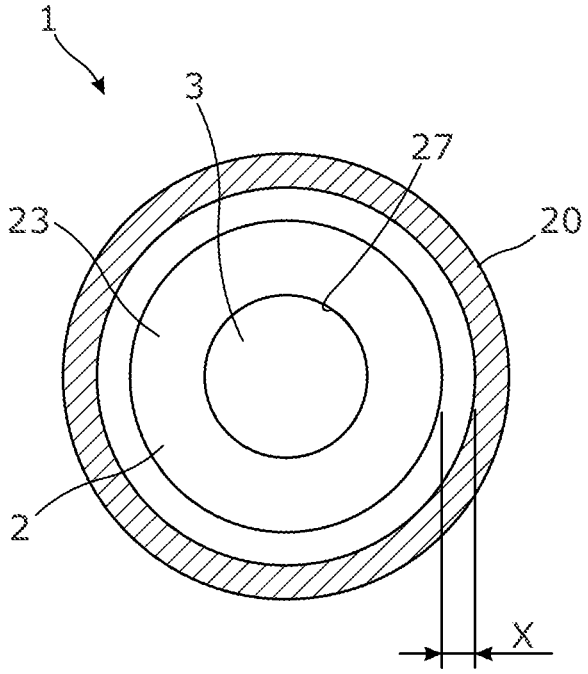
Figure 6:
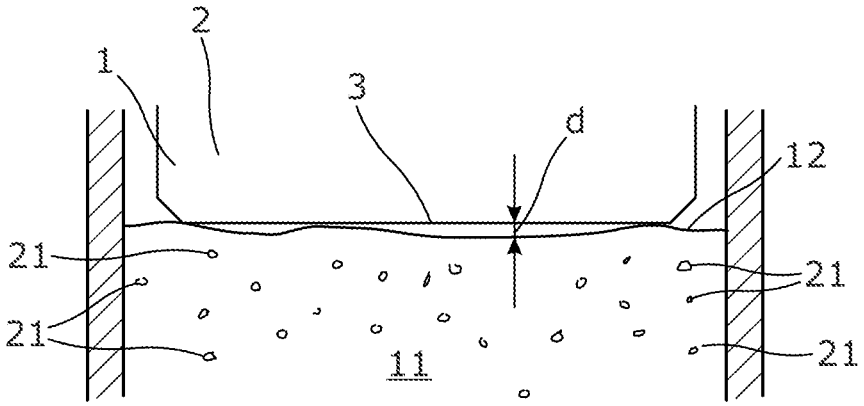
Figure 7:
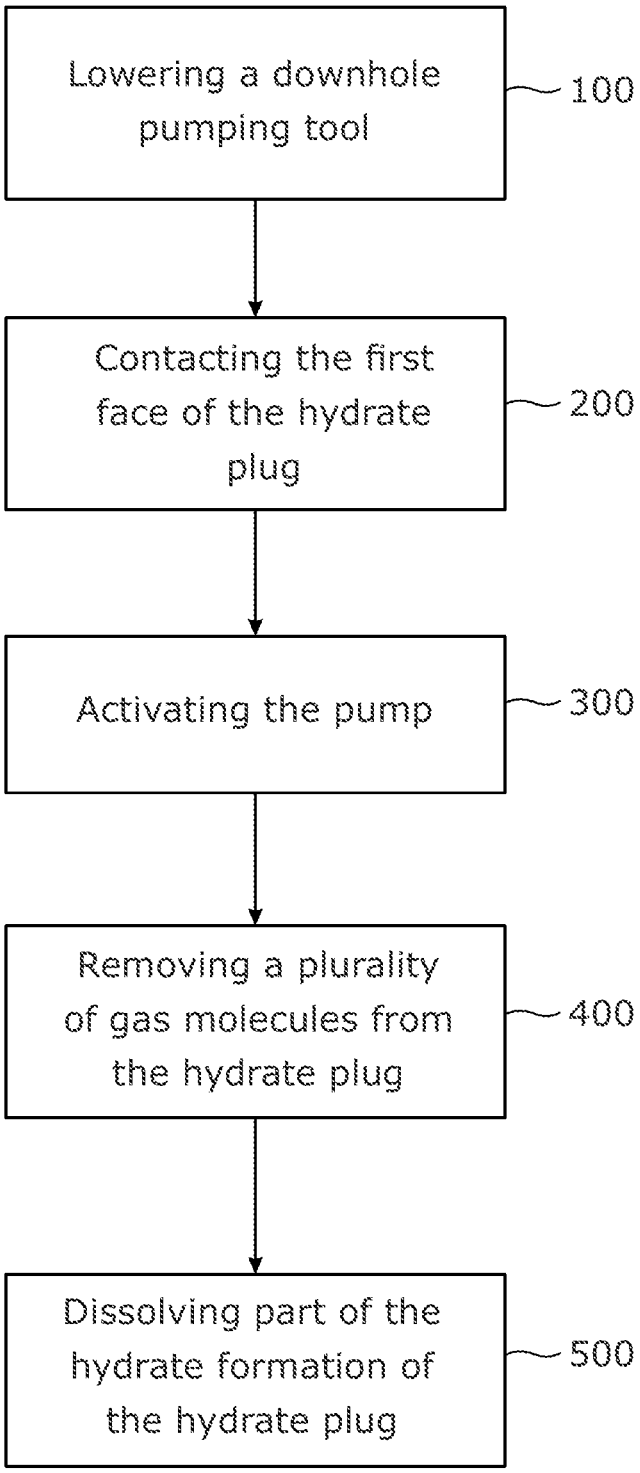

The invention and its many advantages will be described in more detail below with reference to the accompanying schematic drawings, which for the purpose of illustration show some non-limiting embodiments and in which:

FIG. 1 shows a partly cross-sectional view of a well in which a downhole pumping tool abuts a hydrate plug in a tubing, FIG. 2 shows a partly cross-sectional view of a well in which another downhole pumping tool abuts a hydrate plug in a tubing, FIG. 3 shows a partly cross-sectional view of a well in which yet another downhole pumping tool has a driving unit to force the tool to contact the hydrate plug, FIG. 4 shows a partly cross-sectional view of a well in which yet another downhole pumping tool has a drill bit to drill into the hydrate plug in a tubing, FIG. 5 shows the downhole pumping tool in a tubing viewed from the pump inlet, FIG. 6 shows a partly cross-sectional view of part of the second end of the downhole pumping tool, and FIG. 7 shows a hydrate removal method for removing hydrate formation forming/creating a hydrate plug in a tubing.

All the figures are highly schematic and not necessarily to scale, and they show only those parts which are necessary in order to elucidate the invention, other parts being omitted or merely suggested.

FIG. 1 shows a downhole pumping tool 1 which is used for removing a hydrate formation forming a hydrate plug 11 in a tubing 20 in a well. The downhole pumping tool 1 comprises a pump 2 having a pump inlet 3 and a pump outlet 4, the pump being driven by an electric motor 5 powered through a wireline 7. The pump has a first end 23 arranged closest to the wireline and a second end 24 facing the hydrate plug 11 when the downhole pumping tool 1 has been lowered into the tubing 20, and the pump inlet 3 is arranged in the second end and contacts a first face 12 of the hydrate plug 11, and the pump is activated to provide suction, i.e. negative differential pressure, at the pump inlet 3 to remove at least part of a plurality of gas molecules 21 from the hydrate plug 11 for dissolving at least a part of the hydrate plug 11. The downhole pumping tool 1 is a downhole wireline pumping tool and is used to remove the hydrate plug 11 by providing suction/negative pressure at the pump inlet 3 so that the gas at the top of the hydrate plug 11 is sucked out.

When the pump 2 is activated and used to provide negative differential pressure at the pump inlet 3, this suction further removes at least part of the hydrate formation. Hydrate formation is a solid lattice of water molecules enclosing gas molecules 21, and the gas molecules are the essential part of the hydrate as the gas molecules support the solid lattice of water molecules. When the gas molecules 21 are removed from the solid lattice of water molecules, the lattice is no longer supported and collapses, as a result of which the hydrates are dissolved, at least partly, i.e. in the upper part of the hydrate plug where the gas has been removed. The collapsed solid lattice of water molecules is thus also sucked in through the pump inlet 3. As the downhole pumping tool 1 is activated, the pump inlet 3 draws in at least part of the hydrate formation and/or the gas molecules 21. The pump outlet 4 releases or ejects at least part of the hydrate formation as water and gas molecules. The pump 2 provides a suction pressure or negative differential pressure at the pump inlet 3 of at least 5 bar, preferably at least 7 bar, and even more preferably at least 10 bar.

By using the downhole pumping tool 1 to suck gas molecules 21 out of the top of the hydrate plug 11, the hydrate plug 11 is dissolved part by part until the hydrate plug 11 is collapsed and in this way dissolved, no longer preventing passage in the well. With such solution, there is no need for glycol, and a 150-metre-long hydrate plug can be removed/dissolved in one run, and not, as is the case with prior art tools, in several runs in order to transport sufficient glycol to dissolve the hydrate plug. Using the downhole pumping tool 1 to suck gas molecules 21 out of the top of the hydrate plug 11 is an environmentally friendly way of removing a hydrate plug in a well, which is also less time-consuming than the known glycol solution.

The downhole pumping tool 1 further comprises an electric control section 6 arranged between the electric motor and a top connector connecting the wireline. As shown in FIG. 5, the downhole pumping tool 1 occupies most of the inner diameter of the tubing, and when centralised the outer face of the pump 2 of the downhole pumping tool 1 has a distance x to the wall of the tubing, where the distance is less than 50 mm, and preferably less than 25 mm.

The pump inlet 3 is circumferented/surrounded by an edge 27 as shown in FIG. 5, and the pump inlet 3 contacts the first face 12 of the hydrate at least along 25% of the circumference of the pump inlet 3 and the edge, and preferably at least along 50% of the edge. As shown in FIG. 6, the edge of the pump inlet 3 has a distance d of less than 5 mm from the first face, and preferably a distance d of less than 2 mm from the first face at the part of the edge which is not in direct contact with the first face 12. The distance d needs to be as small as possible in order to maximise the suction pressure at the pump inlet 3.

In FIG. 2, the pump 2 further comprises a bailer 10 having a bailer inlet 9 forming the pump inlet 3 so that at least part of the hydrate formation and/or gas molecules 21 are sucked in through the bailer 10. The bailer 10 comprises a filter 26 through which the gas molecules 21 and dissolved water are sucked, leaving some of the hydrate formation released from the hydrate plug 11 in the bailer 10. The gas, water and collapsed lattice of solid water are sucked in through the pump inlet 3, forming the bailer inlet 9, and enter the bailer cavity 8 before the water and gas are sucked in through the filter, in through an intermediate pump inlet 3A and pumped out of the pump outlet 4. By having a bailer 10, the collapsed solid lattice of water is separated from the gas and is accumulated in the bailer 10, and gas and dissolved water are let out of the pump outlet 4.

The edge 27 may be provided with at least one indentation so as to ensure a flow of fluid from the tool surroundings into the pump inlet. The wall of the pump at the second end may be provided with at least one nozzle, valve or opening so as to ensure a flow of fluid from the tool surroundings into the pump or the bailer of the pump. By having the edge comprising at least one indentation or the wall at the second end comprising at least one nozzle, valve or opening, a flow of fluid in through the filter is upheld for sucking the gas molecules and/or water in the event that the edge is sucked into the hydrate.

In order to minimise the distance d between the pump inlet 3 and the first face 12 of the hydrate plug 11, and thus maximise the suction pressure at the pump inlet 3, the downhole pumping tool 1 further comprises a driving unit 14 having wheels 15 on arms 16 for contacting an inner face 25 of the tubing to provide a forward driving force forcing the pump inlet 3 into contact with the first face 12 of the hydrate plug 11, as shown in FIGS. 3 and 4. The driving unit 14, such as a downhole tractor, is powered by a second pump 17, which is powered by a second electric motor 18. The second electric motor 18 is powered by the wireline 7, and an electric control section 19 is arranged between the second electric motor 18 and the wireline 7.

In FIG. 4, the downhole pumping tool 1 further comprises a drill bit 22 arranged in front of the second end for drilling into the hydrate plug 11 and for maximising the contact between the pump inlet 3 and the hydrate plug 11. The drill bit may be rotated in order to drill into the hydrate plug.

As illustrated in FIG. 7, a hydrate removal method for removing hydrate formation forming/creating a hydrate plug in a tubing comprises lowering 100 the downhole pumping tool 1 comprising the pump 2 having the pump inlet 3 and the pump outlet 4, and the electric motor 5 for driving the pump and powered by the wireline 7. The pump 2 has the first end 23 arranged closest to the wireline 7 and the second end 24 facing the hydrate plug 11, where the pump inlet 3 is arranged in the second end 24. The hydrate removal method further comprises contacting 200 the first face 12 of the hydrate plug 11 with the pump inlet 3, activating 300 the pump to provide suction, i.e. negative pressure, through the pump inlet 3, and thereby removing 400 at least part of a plurality of gas molecules 21 from the hydrate plug 11, dissolving 500 at least part of the hydrate formation.

By this hydrate removal method, the hydrate plug can be removed in one run and without having to use non-environmentally friendly additives or glycol. Sucking the gas out of the hydrate plug due to the suction/negative pressure at the pump inlet provides a method which can continue until the full hydrate plug is removed from the well.

The hydrate removal method further comprises retracting the downhole pumping tool 1 into a lubricator and circulating fluid in through the pump in order to flush the pump before the tool is re-entered into the well for contacting the face of the part of the hydrate plug not yet dissolved. By retracting the downhole pumping tool 1 before re-entering the well again, hydrate formation will not recur above the downhole pumping tool 1 while sucking gas molecules out of the hydrate plug as the retraction of the downhole pumping tool 1 will prohibit hydrate formation.

The hydrate removal method may further comprise sucking the plurality of gas molecules 21 into a bailer 10 of the pump 2 after passing the pump inlet 3. In this way, the released hydrate is accumulated in the bailer 10, and the hydrate formation above the downhole pumping tool 1 is thus avoided, the retraction of the downhole pumping tool 1 being minimised, if not fully avoided.

If needed, the hydrate removal method further comprises retracting the downhole pumping tool 1 into the lubricator and circulating fluid in through the bailer 10 in order to clean the bailer of hydrate before the downhole pumping tool 1 re-enters the well to continue sucking gas and removing further parts of the hydrate plug 11. Then the hydrate removal method further comprises lowering the downhole pumping tool 1 until the pump inlet 3 contacts the first face 12 of the hydrate plug 11, the pump being activated again to provide suction through the pump inlet 3, removing a further part of a plurality of gas molecules 21 from the hydrate plug 11 and dissolving at least part of the hydrate formation.

In order to increase the suction pressure, the hydrate removal may further comprise drilling into the first face 12 of the hydrate plug 11, releasing part of the formation by means of a drill bit arranged in front of the second end 24.

In another way of increasing the suction pressure, the hydrate removal method further comprises forcing the pump inlet 3 towards the first face 12 of the hydrate plug 11 by means of a driving unit having wheels 15 on arms 16 for contacting an inner face 25 of the tubing, the wheels being driven to rotate. By forcing an edge providing the pump inlet 3 towards the first face of the hydrate plug 11, the pump inlet 3 contacts the first face 12 by means of the pump inlet 3 at least along 25% of the edge, and preferably at least along 50% of the edge. The part of the edge of the pump inlet 3 not contacting the first face 12 is arranged so that part of the edge has a distance d of less than 5 mm, and preferably a distance d of less than 2 mm. Furthermore, the driving unit 14, such as a downhole tractor, also helps the pump inlet 3 of the downhole pumping tool 1 come into contact with the hydrate plug 11, and as the plug is partly dissolved the downhole pumping tool 1 needs to move the pump inlet 3 further down the tubing if the weight from the downhole pumping tool 1 itself is not enough to keep the pump inlet 3 sufficiently close to the hydrate plug 11.

The hydrate removal method provides suction pressure by means of the pump at the pump inlet 3 of at least 5 bar, preferably at least 7 bar, and even more preferably at least 10 bar.

The distance between the pump inlet 3 and the first face 12 of the hydrate plug 11 may also be minimised by a stroking tool, which is a tool providing an axial force along the extension of the tubing. The stroking tool comprises an electric motor for driving a pump. The pump pumps fluid into a piston housing to move a piston acting therein. The piston is arranged on the stroker shaft. The pump may pump fluid out of the piston housing on one side and simultaneously suck fluid in on the other side of the piston.

By "fluid" or "well fluid" is meant any kind of fluid that may be present in oil or gas wells downhole, such as natural gas, oil, oil mud, crude oil, water, etc. By "gas" is meant any kind of gas composition present in a well, completion or open hole, and by "oil" is meant any kind of oil composition, such as crude oil, an oil-containing fluid, etc. Gas, oil and water fluids may thus all comprise other elements or substances than gas, oil and/or water, respectively.

By "tubing", "casing" or "well tubular metal structure" is meant any kind of pipe, tubing, tubular, liner, string, etc., used downhole in relation to oil or natural gas production.

In the event that the tool is not submergible all the way into the casing, the downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described above in connection with preferred embodiments of the invention, it will be evident to a person skilled in the art that several modifications are conceivable without departing from the invention as defined by the following claims.

The invention claimed is:

1. A downhole pumping tool for removing a hydrate formation forming a hydrate plug in a well, the downhole pumping tool configured to be arranged in a well tubular metal structure in the well, the pumping tool comprising:

a pump having a pump inlet and a pump outlet, an electric motor configured to drive the pump, and a wireline configured to power the electric motor, the pump having a first end arranged closest to the wireline and a second end configured to face the hydrate plug, wherein the pump inlet is arranged in the second end, and the pump inlet is positioned and configured to contact a first face of the hydrate plug, the pump being configured to provide suction to remove at least part of a plurality of gas molecules from the hydrate plug through the pump inlet for dissolving at least part of the hydrate formation, and wherein the pump outlet is configured to release at least part of the hydrate formation as water and gas into the well tubular metal structure in the well, and wherein the pump further comprises a bailer having a bailer inlet forming the pump inlet, the bailer comprising a filter configured to allow passage of gas molecules and dissolved water to the pump outlet, leaving at least a part of the hydrate formation in the bailer such that the part of the hydrate formation does not pass through the pump outlet, wherein the pump outlet is located further towards the first end and the wireline compared to the pump inlet.

2. The downhole pumping tool according to claim 1, wherein the pump is configured to provide suction to further remove at least part of the hydrate formation.

3. The downhole pumping tool according to claim 1, wherein the pump inlet is configured to draw in at least part of the hydrate formation and/or gas molecules.

4. The downhole pumping tool according to claim 1, wherein the pump is configured to provide suction pressure at the pump inlet of at least 5 bar.

5. The downhole pumping tool according to claim 1, wherein the pump inlet is surrounded by an edge, and the pump inlet is configured to contact the first face at least along 25% of the edge.

6. The downhole pumping tool according to claim 5, wherein the pump inlet, at part of the edge, is configured to be spaced a distance of less than 5 mm from the inlet to the first face.

7. The downhole pumping tool according to claim 5, wherein the pump inlet, at part of the edge, is configured to be spaced a distance of less than 2 mm from the inlet to the first face.

8. The downhole pumping tool according to claim 1, wherein the the bailer is configured so that at least part of the hydrate formation and/or gas molecules are sucked in through the bailer.

9. The downhole pumping tool according to claim 1, wherein the pump is configured to provide suction pressure at the pump inlet of at least 7 bar.

10. The downhole pumping tool according to claim 1, wherein the pump is configured to provide suction pressure at the pump inlet of at least 10 bar.

11. The downhole pumping tool according to claim 1, wherein the pump inlet is surrounded by an edge, and the pump inlet is configured to contact the first face at least along 50% of the edge.

12. The downhole pumping tool according to claim 1, wherein the hydrate plug includes a lattice of water molecules supported by the gas molecules, and wherein the pump is configured and positioned, using the suction, to remove at least part of the plurality gas molecules from the hydrate plug, thus leaving only the lattice of water molecules that collapse due to removal of the gas molecules and are subsequently sucked into the inlet.

13. The dowhhole pumping tool according to claim 1, wherein the pump inlet is located at the second end to provide the suction at the second end, and the pump is configured to separate the gas molecules from the hydrate plug and suck the gas molecules through the pump inlet, thus leaving only unsupported water molecules subsequently sucked through the pump inlet.

14. The downhole pumping tool according to claim 1, further comprising a drive unit and a controller to control the drive unit to maintain the pump inlet at a predetermined distance from the first face of the hydrate plug when applying suction.

15. The downhole pumping tool according to claim 1, wherein a first part of the pump inlet is configured to contact the first face of the hydrate plug while a second part of the pump inlet is configured to be spaced from the hydrate plug, thus ensuring flow of fluid from the tool surroundings into the pump inlet.

16. A hydrate removal method for removing a hydrate formation forming a hydrate plug in a tubing, comprising:

lowering a downhole pumping tool comprising a pump having a pump inlet and a pump outlet, an electric motor configured to drive the pump, and a wireline configured to power the electric motor, the pump having a first end arranged closest to the wireline and a second end facing the hydrate plug, the pump inlet being arranged in the second end, wherein the pump outlet is located further towards the first end and the wireline compared to the pump inlet, contacting a first face of the hydrate plug with the pump inlet, activating the pump to provide suction through the pump inlet, removing at least part of a plurality of gas molecules from the hydrate plug through the pump inlet, dissolving at least part of the hydrate formation, and releasing at least part of the hydrate formation as water and gas into the tubing, wherein the method further comprises sucking the plurality of gas molecules and dissolved water into and through a filter of a bailer of the pump after passing the pump inlet, leaving at least a part of the hydrate formation in the bailer such that the part of the hydrate formation does not pass through the pump outlet.

17. The hydrate removal method according to claim 16, further comprising retracting the downhole pumping tool and circulating fluid through the pump.

18. The hydrate removal method according to claim 16, further comprising retracting the downhole pumping tool and circulating fluid through the bailer.

19. The hydrate removal method according to claim 18, further comprising activating the pump again to provide suction through the pump inlet, removing a further part of a plurality of gas molecules from the hydrate plug, and dissolving at least part of the hydrate formation.

20. The hydrate removal method according to claim 16, further comprising providing a suction pressure by means of the pump at the pump inlet of at least 5 bar.

* * * * *